US006413603B1

(12) United States Patent
Horton et al.

(10) Patent No.: US 6,413,603 B1
(45) Date of Patent: Jul. 2, 2002

(54) PLACEMATS HAVING INTEGRATED ADHESIVE STICKERS OR LABELS

(75) Inventors: Katherine C. Horton, Kansas City, MO (US); Mark C. Rogers, Miamisburg, OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 08/452,737

(22) Filed: May 30, 1995

(51) Int. Cl.[7] ..... G09F 3/00

(52) U.S. Cl. ..... 428/40.1; 428/42.1; 428/42.2; 428/42.3; 428/43; 428/220; 434/97; 434/155

(58) Field of Search ..... 428/40, 41, 42, 428/43, 220; 434/97, 155

(56) References Cited

U.S. PATENT DOCUMENTS

| | | | | |
|---|---|---|---|---|
| 416,171 A | | 12/1889 | Mahoney | 446/97 |
| 3,383,121 A | | 5/1968 | Singer | 462/66 |
| 3,750,309 A | | 8/1973 | Tovar | 283/63 |
| 4,235,459 A | * | 11/1980 | Callahan | 428/40 |
| 4,439,941 A | | 4/1984 | Halperin | 40/124.1 |
| 4,510,006 A | * | 4/1985 | Lawson | 428/42 |
| 4,568,108 A | | 2/1986 | Simpson | 281/5 |
| 4,627,994 A | | 12/1986 | Welsch | 428/41 |
| 4,652,239 A | * | 3/1987 | Brimberg | 428/42 |
| 4,712,673 A | | 12/1987 | Moore | 206/232 |
| 4,778,153 A | | 10/1988 | Bachman et al. | 283/101 |
| 4,809,905 A | | 3/1989 | Goodman | 229/70 |
| 4,811,951 A | | 3/1989 | Dorsey-Zinn et al. | 434/84 |
| 4,944,968 A | | 7/1990 | Wagner | 428/13 |
| 4,983,438 A | * | 1/1991 | Jameson | 428/41 |
| 5,006,191 A | | 4/1991 | Schmidt | 156/268 |
| 5,036,472 A | | 7/1991 | Buckley et al. | 364/479 |
| 5,096,752 A | | 3/1992 | Wagner | 428/13 |
| 5,106,305 A | | 4/1992 | Grant | 434/84 |
| 5,129,682 A | * | 7/1992 | Ashby | 283/81 |
| 5,135,789 A | | 8/1992 | Schmidt | 428/42 |
| 5,244,394 A | | 9/1993 | Serabian-Musto | 434/263 |
| 5,248,536 A | | 9/1993 | Du Katz | 428/40.1 |
| 5,262,215 A | | 11/1993 | Shields | 428/40.1 |
| 5,269,691 A | | 12/1993 | Waldman | 434/429 |
| 5,292,154 A | | 3/1994 | Williams | 283/2 |
| 5,377,904 A | | 1/1995 | Michlin et al. | 229/70 |
| 5,397,052 A | | 3/1995 | Walz | 229/300 |
| 5,507,901 A | * | 4/1996 | Limina | 428/352 |
| 5,512,612 A | * | 4/1996 | Brown | 523/218 |
| 6,258,428 B1 | * | 7/2001 | Phillips | 428/42.1 |

FOREIGN PATENT DOCUMENTS

| | | |
|---|---|---|
| DE | 441900 | 11/1925 |
| DE | 9315699 | 2/1994 |
| GB | 2090146 | 7/1982 |

* cited by examiner

*Primary Examiner*—Nasser Ahmad
(74) *Attorney, Agent, or Firm*—Francis L. Conte

(57) ABSTRACT

Placemats having integrated adhesive stickers or labels constructed as a single sheet integrated placemat product. A preferred embodiment of the present invention is fabricated from a preprinted bond paper sheet having an underlying silicone coated kraft paper liner adhered to at least a portion of the rear side of the preprinted bond paper sheet. Portions of the preprinted bond paper sheet have die cuts which permit removal of preprinted designs on the integrated adhesive stickers or labels. Children or other interested patrons complete drawings on the placemats by placing or positioning the adhesive stickers or labels wherever the children or other interested patrons choose on the placemats. If desired, the adhered stickers and/or the remainder of the placemats may be further decorated or colored using various writing instruments, including pencils, pens, ink markers and crayons, to create a picture or artistic scene.

16 Claims, 5 Drawing Sheets

PLACEMATS HAVING INTEGRATED ADHESIVE STICKERS OR LABELS

BACKGROUND AND SUMMARY OF THE INVENTION

The present invention relates generally to new and novel improvements in placemats having integrated adhesive stickers or labels. More particularly, the present invention relates to placemats having integrated adhesive stickers or labels which are particularly suitable for use in restaurants and other dining establishments for sanitary and entertainment purposes and are preferably capable of having information printed thereon using conventional printing methods or by children and interested patrons using various writing instruments, such as pencils, pens, ink markers and crayons.

Many restaurants and other dining establishments provide preprinted paper placemats and writing instruments, such as pencils, pens, ink markers or crayons, to children and other interested patrons for engaging play or entertainment, as well as for sanitary purposes, aesthetic decoration and advertising before, during and after eating meals in public. Common examples include preprinted placemats which are used to cover bare dining tables in family dining establishments or food-carrying tray preprinted paper covers which are often used in cafeteria-style or fast-food dining establishments. These preprinted placemats are often accompanied with writing instruments, such as pencils, pens, ink markers or crayons, to allow children and other interested patrons to draw pictures or "doodle" while waiting for the meal to be prepared or while dining. Such preprinted placemats often include aesthetic pictorial scenes, to-be-colored line art, word games, menus and many other types of advertising that concern the dining establishment or other area businesses.

Many family-oriented dining establishments wish to provide some form of entertainment for children and other interested patrons, particularly from the time customers first sit down at a table until the time when the prepared meals are brought to their table. This is desirable because family-oriented dining establishments generally wish to preoccupy children to reduce unwanted, disruptive behavior which may negatively impact the parents' and other patrons' enjoyment of their dining experience. In addition, family-oriented dining establishments generally wish to create an enjoyable experience for the children. In general, the more enjoyable a dining experience is for both children, as well as their parents, the more likely it is that families will again patronize a particular dining establishment.

To enhance the entertainment value of conventional preprinted paper placemats, some dining establishments provide drawing instruments, such as pencils, pens, ink markers and crayons, and/or adhesive stickers separate from and in additional to the preprinted paper placemats. For example, a preprinted placemat may have preprinted designs which encourage children and other interested patrons to color specific areas with crayons in particular colors to create a colorful picture. Similarly, children and other interested patrons may be encouraged to decorate a preprinted picture with separately provided adhesive stickers which are adhered to specific areas to create a colorful picture. As a practical matter, such additional materials are problematic to dining establishments in that multiple items must be inventoried and dispensed to children and other interested patrons. Furthermore, it is common for children to "draw" or misuse and place adhesive stickers onto the dining establishment's fixtures, such as tables, chairs, windows, glassware, plates, etc. In such a case, dining establishment employees have the duty of removing such unwanted markings and adhesive stickers. This is time consuming for the employees and costly for the dining establishment.

Applicant is aware of several types of construction for prior art placemats and other entertainment products for dining establishments. A first known type of construction is a conventional preprinted placemat constructed from a rectangular sheet of bond paper with either one or two-sided printing. Such preprinting may convey a static design, such as a menu or pictorial scene. While such a design performs the sanitary purpose of a placemat and may convey information to customers, it fails to provide interactive, entertainment-oriented features.

A second known type of construction for prior art placemats and other entertainment products for dining establishments is a preprinted placemat constructed from a rectangular sheet of bond paper with either one or two-sided printing. Typically, this type of construction allows for creative input from children and other interested patrons in the form of games to play, pictures to draw or adhesive stickers to adhere to the preprinted placemat. While the second known type of construction for the preprinted placemat itself is similar to that described in conjunction with the first known type of construction above, the second type of construction generally requires separate drawing instruments, such as pencils, pens, ink markers or crayons, and/or separate pressure sensitive adhesive or "lick-and-stick" dry gum stickers. Disadvantages of this second known type of construction include having to provide additional materials, i.e., the drawing instruments and/or the adhesive stickers, as well as potential clean-up problems due to misuse of these materials.

A third known type of prior art product is conventional sticker books. That is, books specifically designed for children to place adhesive stickers on or inside a bound book to create or complete drawings or a story line. Such sticker books are often sold through retail stores and are also supplied to children and other interested patrons by dining establishments. Disadvantages of this type of prior art product include that the cost of such sticker books are often relatively high. Furthermore, they lack sanitary use in dining environments since such sticker books are typically not intended to be disposable or used as a barrier between a table surface and food. In addition, many such adhesive sticker products are fabricated from plastic materials and permanent adhesives making clean-up due to product misuse burdensome and costly.

Known prior art United States patents include U.S. Pat. No. 416,171 to Mahoney for an "Article of Amusement and Instruction for Children". This patent describes the use of one or more sheets or cards of paper or similar material having pictorial illustrations of landscapes and similar outdoor views and of houses and the interiors of the same, together with means for applying to different places on said landscape or to said interior portions of the house representations of objects belonging thereto and of changing the positions of said objects at will.

U.S. Pat. No. 3,750,309 to Tovar for a "Display Book" describes a display book for displaying table settings of preselected patterns of silverware, china and crystal.

U.S. Pat. No. 4,510,006 to Lawson for a "Personalized Laminated Display" describes personalized placemats and posters which may selectively use precisely shaped, precisely spaced and located alpha-numeric symbols of indicia for said personalization.

U.S. Pat. No. 4,712,673 to Moore for a "Combination Food Carrier and Amusement Device" describes an amusement device and children's book which also functions as a carrier for various food items, such as hamburgers and french fries.

U.S. Pat. No. 4,778,153 to Bachman, et al. for a "Promotional Article with Pressure-Sensitive Adhesive Portions and Method of Manufacture" describes a promotional article and method of making same having a pressure-sensitive adhesive without laminating a separate release sheet to the sheet upon which the pressure-sensitive adhesive is applied.

U.S. Pat. No. 4,811,951 to Dorsey-Zinn, et al. for a "Puzzle Including Pieces Formed From a Crayon Material" describes a puzzle with two sets of puzzle pieces which can be interchangeably used to complete the puzzle, where one set of puzzle pieces is formed from a crayon material which can be used to color by a child.

U.S. Pat. No. 4,944,968 to Wagner for a "Placemat with Changeable Card Display" and related Continuation-in-Part U.S. Pat. No. 5,096,752 to Wagner for a "Placemat with Changeable Card Display" describe dining room placemats which include a plurality of pockets, each suitable to accommodate an available celebrity card, the pockets being preferably formed of clear plastic liquid impervious film and mounted to an upper panel of the placemat without obscuring printed or painted indicia appearing on the upper panel.

U.S. Pat. No. 5,106,305 to Grant for a "Picture Making Kit" describes a picture making kit including a base sheet carrying a predetermined pattern or "graphic grid", a plurality of filling elements which can be applied to the pattern by the user and an overlay sheet or "master graphic" which is superimposed on the base sheet after the filling elements have been applied and which carries a pattern of transparent, translucent or cut-out "windows" so as to create a finished picture made up of separate areas visible through the "windows" of the overlay.

U.S. Pat. No. 5,129,682 to Ashby for a "Business Form with Labels" describes a business form having at least one label associated with and removable from the business form. The business form includes a paper ply having a front face and a rear face, first and second side edges parallel to each other and means defining tractor feed openings adjacent the first and second edges. A piece of transfer tape having an adhesive covered release face, a non-adhesive covered back face, and a pair of parallel side edges is positioned such that the adhesive face of the transfer tape is attached to the paper ply rear face with the side edges of the transfer tape between the tractor openings adjacent the first and second edges of the paper ply, and the transfer tape edges parallel to the first and second edges and at least one die cut formed in the paper ply front face to define, with adhesive from the transfer tape, at least one removable label.

U.S. Pat. No. 5,262,215 to Shields for a "Laminated Article for Having Separate Pieces for Detachable Placement on a Background" describes a laminated article which includes a web adhesively and detachable coupled with a carrier sheet. The web includes a support layer and a top layer releasably adhered thereto configured to present a plurality of separable pieces. The carrier and pieces are imprinted with cooperating indicia for playing a game or creating a scene. Additionally, a dry release adhesive is used to adhere the respective marginal zones of the web and carrier.

U.S. Pat. No. 5,269,691 to Waldman for a "Sticker Activity and Coloring Book" describes a sticker activity and coloring book including a sticker page containing a plurality of removable adhesively backed stickers, a scene page associated with the sticker page and having a scene printed in color thereon and a release coating for receiving the stickers, an instructional page associated with the sticker and scene pages and showing, in black and white outline, the scene on the scene page and one arrangement of the stickers on the scene so that a user of the book may remove one of the stickers from the sticker page and transfer the removed sticker onto the scene page as shown on the instructional page and such transfer may continue until all of the stickers have been placed on the scene page and the instructional page having a surface adapted to receive coloring from a coloring instrument, so that the instructional page may be colored by the user.

U.S. Pat. No. 5,292,154 to Williams for a "Method and Materials for Calendar Fabrication Renewal" describes a method of creating unexpired pictorial calendars which are produced by adherently attaching calendar stickers to bound pages. The pages are printed with artwork. The artwork is viewed with the calendar information printed on the calendar stickers. The calendar stickers have an adhesive for attachment to the pages. Expired pictorial calendars can be renewed for future use by covering expired calendar information with the calendar stickers. Also, bound artwork from any source can be converted into a pictorial calendar.

As described above, all known prior art types of construction for printed paper placemats and entertainment products have disadvantages which limit their acceptance by issuing dining establishments, the end users or both.

Accordingly, an object of the present invention is the provision of placemats having integrated adhesive stickers or labels which provide children and other interested patrons with a single integrated physical and interactive entertainment medium which encourages interaction and possible enhanced enjoyment resulting in goodwill and repeat patronage with less effort and cost on the part of dining establishes and related businesses.

Another object of the present invention is to provide placemats having integrated adhesive stickers or labels which provide the traditional sanitary function of placemats, thus enabling traditional placemat business users to enhance their goodwill and repeat patronage with less effort and cost on the part of dining establishments and related businesses.

Yet another object of the present invention is to provide placemats having integrated adhesive stickers or labels which reduce the clean-up time and cost resulting from misuse of traditional sticker products on dining establishments and related businesses fixtures, such as tables, chairs, windows, glassware, etc.

Still another object of the present invention is to provide placemats having integrated adhesive stickers or labels which utilize a removable pressure sensitive label adhesive and paper construction with is biodegradable and recyclable.

A further object of the present invention is to provide placemats having integrated adhesive stickers or labels which can be taken by customers and end users from the dining establishments or similar businesses after dining for continued entertainment and instructional use.

Yet a further object of the present invention is to provide placemats having integrated adhesive stickers or labels which are more user-friendly and sanitary than alternative "lick and stick" or dry gum adhesive stickers.

Still a further object of the present invention is to provide placemats having integrated adhesive stickers or labels which provide entertaining and instructional activities with a single sheet integrated placemat product.

Yet still a further object of the present invention is to provide placemats having integrated adhesive stickers or labels which children and interested patrons may decorate or "color" using writing instruments, such as pencils, pens, ink markers and crayons.

These and other objects of the present invention are attained by the provision of placemats having integrated adhesive stickers or labels constructed as a single sheet integrated placemat product. A preferred embodiment of the present invention is fabricated from a preprinted bond paper sheet having an underlying paper liner adhered to at least a portion of the rear surface of the printed bond paper sheet. Portions of the printed bond paper sheet have die cuts which permit removal of the preprinted designs on the integrated adhesive stickers or labels. Children and other interested patrons complete drawings on the placemats by placing or positioning the adhesive stickers or labels wherever the children or other interested patrons choose on the placemats. If desired, the adhered stickers and/or the remainder of the placemats may be further decorated or colored using various writing instruments, including pencils, pens, ink markers and crayons, to create a picture or artistic scene.

Other objects, advantages and novel features of the present invention will become apparent in the following detailed description of the invention when considered in conjunction with the accompanying drawings.

DETAILED DESCRIPTION OF THE DRAWINGS

Figure 1:
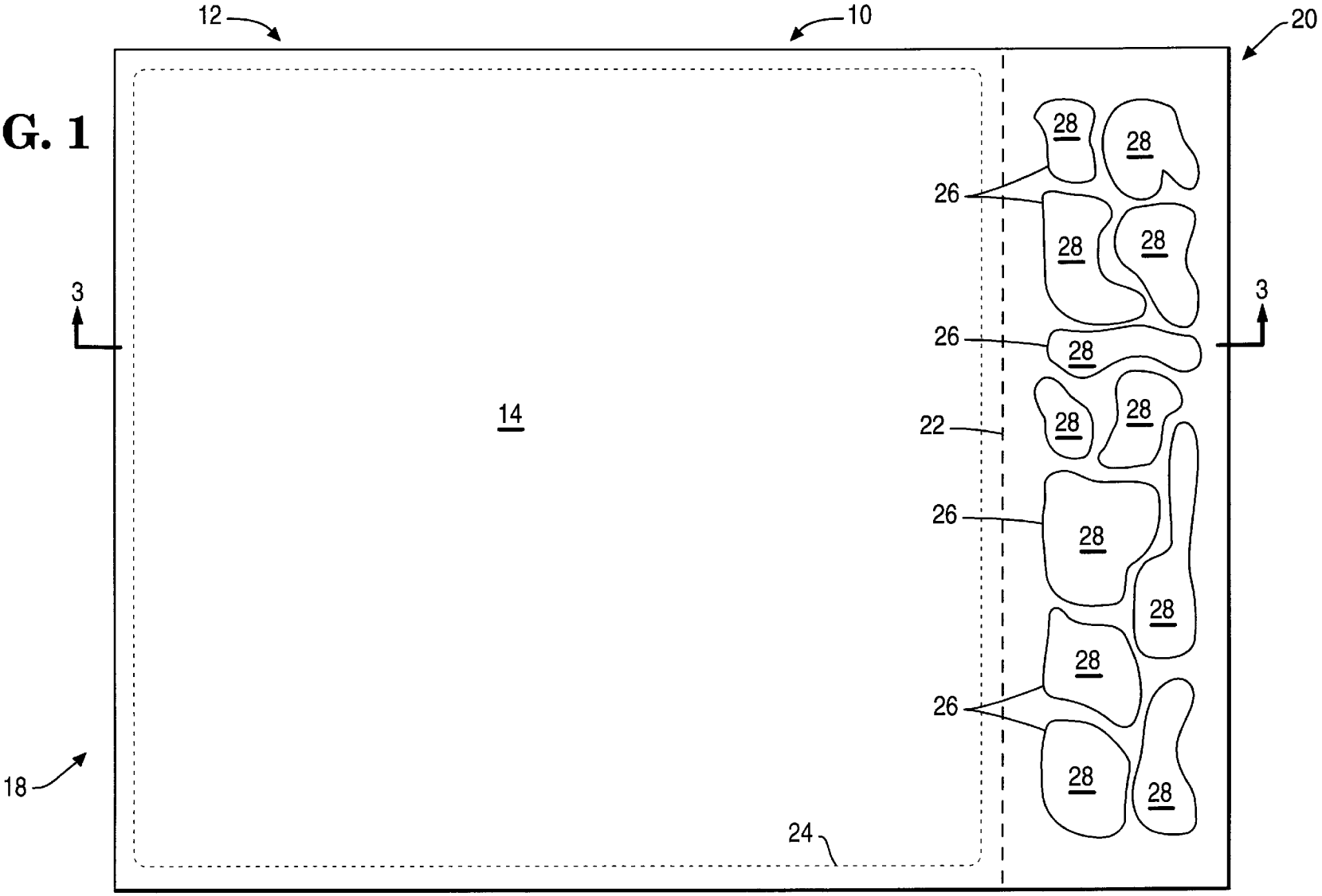
FIG. 1 illustrates a front plan view of a placemat having integrated adhesive stickers or labels in accordance with a preferred embodiment of the present invention.

Referring now to the drawings, in which like-referenced characters indicate corresponding elements throughout the several views, attention is first directed to FIG. 1 which illustrates a front plan view of a preferred embodiment of a placemat having integrated adhesive stickers or labels, generally identified by reference numeral 10. Placemat having integrated stickers or labels 10 generally includes bond paper sheet 12, preferably a rectangular sheet of 20 to 28 pound bond paper stock, most preferably 20 pound paper stock, adhesive 30 and liner 40. Bond paper sheet 12 preferably includes front surface 14 and rear surface 16 and in one preferred embodiment is a rectangular paper bond sheet approximately 10½ inches in height by approximately 14 inches in width. In placemat having integrated adhesive stickers or labels 10 shown in FIG. 1, bond paper sheet 12 is separated into drawing portion 18 and integrated adhesive sticker or label portion 20. Drawing portion 18 is preferably separated from integrated adhesive sticker or label portion 20 by a series of perforations 22, which permits removal of drawing portion 18 from integrated adhesive sticker or label portion 20. Perforations 22 are most preferably micro-fine perforations which permit easy separation of drawing portion 18 and integrated adhesive sticker or label portion 20. Front surface 14 of drawing portion 16 of bond paper sheet 12 includes, if desired, a preprinted design and outside border 24, which preferably includes radiused corners, to indicate the boundary within which the adhesive stickers and labels are to be placed.

Figure 2:
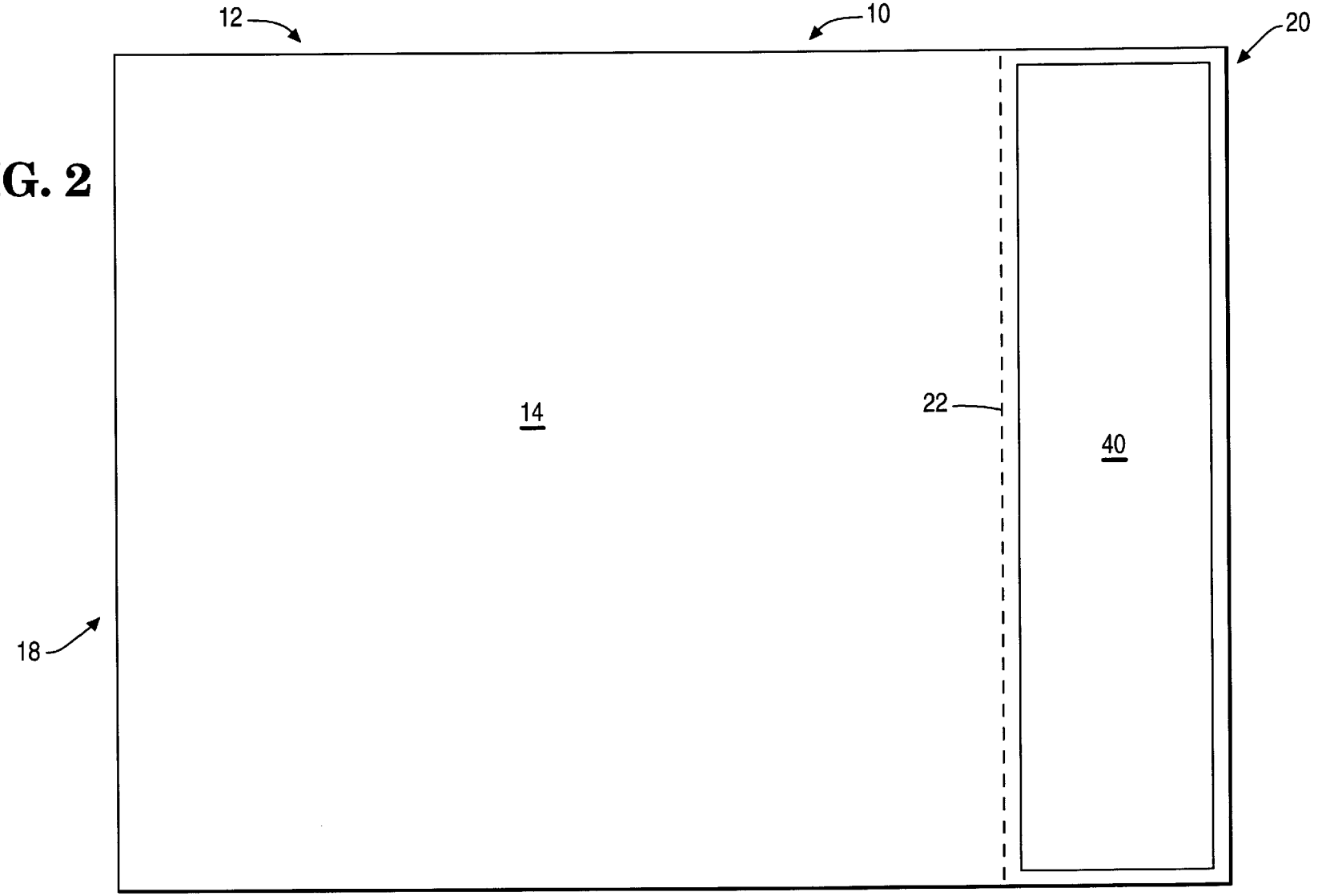
FIG. 2 is a back view of the preferred embodiment of a placemat having integrated adhesive stickers or labels shown in FIG. 1.
Figure 3:
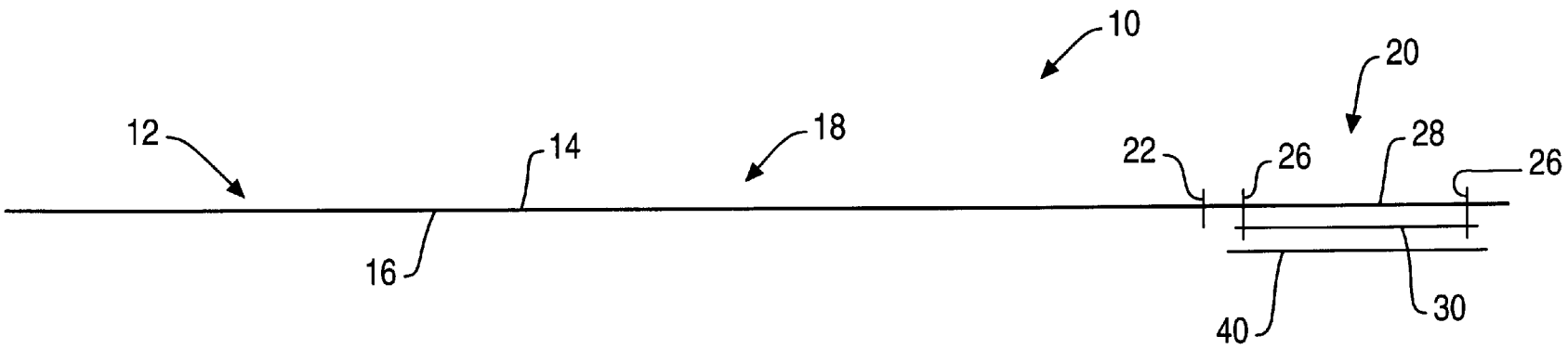
FIG. 3 is an exaggerated separated cross-sectional side view of the preferred embodiment of a placemat having integrated adhesive stickers or labels shown in FIG. 1, taken across lines 3—3 in FIG. 1.

Referring now to FIGS. 2 and 3, liner 40 is adhered by adhesive 30 to rear surface 16 of integrated adhesive sticker or label portion 20. Adhesive 30 is preferably a pressure sensitive adhesive and liner 40 is preferably a silicone coated draft paper, most preferably a 35# silicone-coated kraft liner. A series of continuous die cuts 26 extend through bond paper sheet 12, but not through liner 40, to form adhesive stickers or labels 28. Adhesive stickers or labels 28 can be removed along continuous die cuts 26 and placed at desired positions on drawing portion 18 inside outside border 24. Liner 40 preferably has a silicone coating which permits adhesive 30 to remain on rear surface 16 of adhesive stickers or labels 28 to permit adhesive stickers or labels 28 to adhere to drawing portion 18.

Figure 4:
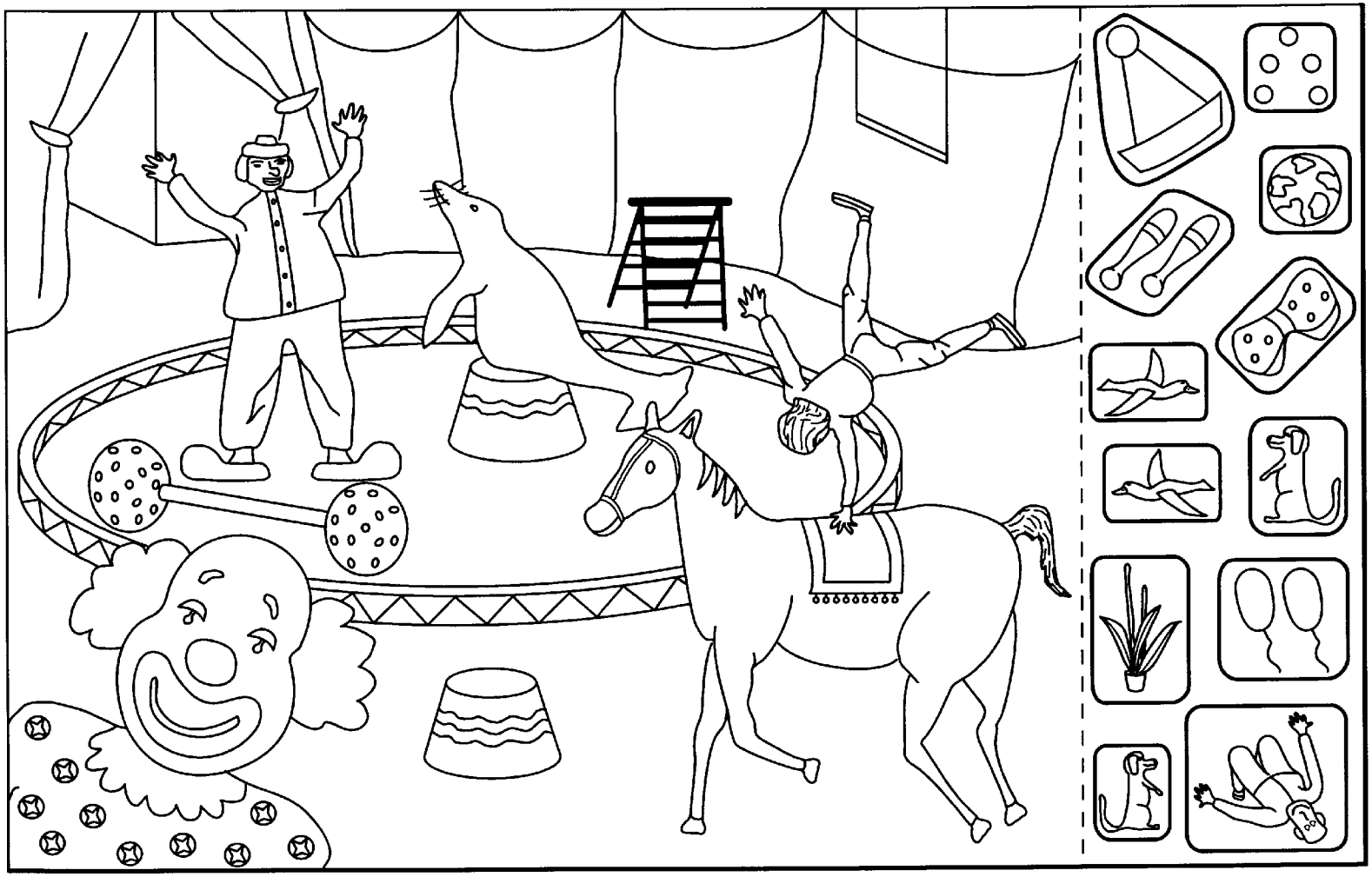
FIG. 4 is a front plan view of a preferred embodiment of a placemat having integrated adhesive stickers or labels showing an illustrative preprinted circus scene and associated preprinted adhesive stickers or labels.
Figure 5:
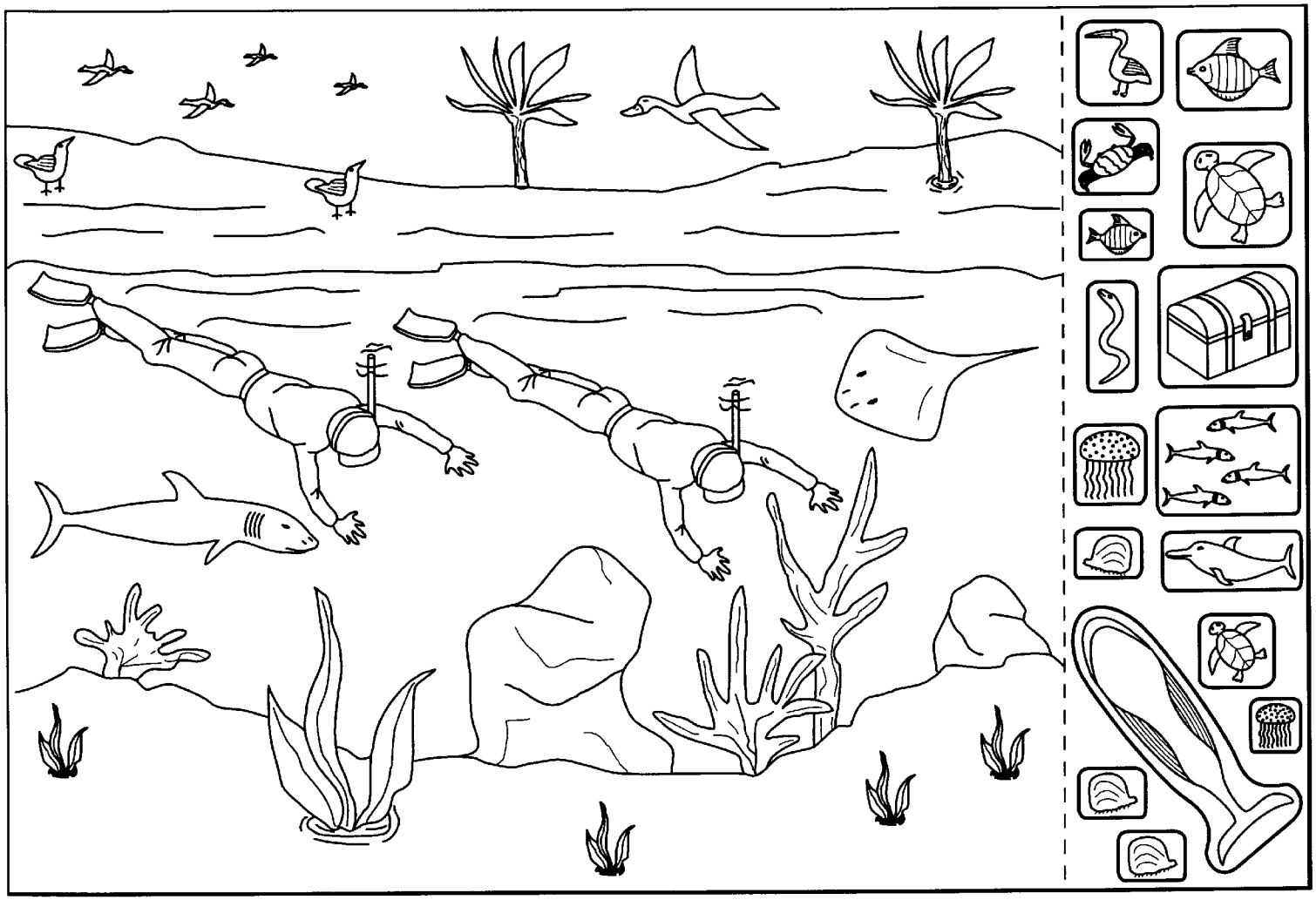
FIG. 5 is a front plan view of a preferred embodiment of a placemat having integrated adhesive stickers or labels showing an illustrative preprinted underwater ocean scene and associated preprinted adhesive stickers or labels.

As seen in FIG. 4, drawing portion 18 and adhesive stickers or labels 28 can be preprinted to represent, in this example, a circus theme. Similarly, as seen in FIG. 5, drawing portion 18 and adhesive stickers or labels 28 can be preprinted to represent, in this example, an underwater ocean scene. It will be appreciated that various other drawings and scenes can be preprinted on drawing portion 18 and/or adhesive stickers or labels 28 using the teachings of the present invention to provide entertainment and educational activities for children and other interested patrons. Furthermore, since drawing portion 18 and adhesive stickers or labels 28 are fabricated from a bond paper sheet material, they can be further decorated or colored using a variety of writing instruments, including pencils, pens, ink markers and crayons.

Thus, it will be readily recognized that placemat having integrated adhesive stickers or labels 10 in accordance with the present invention provides entertaining and educational activities for children and other interested patrons without additional play items such as drawing instruments because adhesive stickers or labels 28 are used to decorate drawing portion 18. Adhesive 30 is preferably selected to be removable from restaurant fixtures and other items when adhesive stickers or label are misused by children and other interested patrons. Furthermore, since adhesive stickers or labels 28 are fabricated from a bond paper sheet material, they disintegrate in mechanical dishwashers if adhesive stickers or labels 28 are left adhered on tableware.

Thus, it will be readily recognized that placemat having integrated adhesive stickers or labels 10 addresses many of the disadvantages inherent in known prior art placemat products. Various changes in the size, configuration and design of drawing portion 18 and adhesive stickers or labels 28 will be readily apparent to those having ordinary skill in the relevant art. For example, dining establishments could provide for special "prizes" under certain preselected stickers or labels. In one embodiment of this type, four stickers or labels are provided in the "prize" peel off section of placemat having integrated adhesive stickers or labels 10 giving the user four tries at winning a "prize". Prizes such as an ice cream cone, a box of crayons, etc. are preprinted on the surface of liner 40 below the "winning" adhesive stickers or labels 28. In such an arrangement, it is anticipated that "prize" messages would be preprinted on the back of liner 40 prior to application of liner 40 and die cutting. Furthermore, an opaque material would preferably be used for liner 40 to prevent the visibility of the "prizes" prior to removal of adhesive stickers or labels 28.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A placemat having at least one integrated adhesive sticker or label, comprising:

a bond paper sheet having a front surface and a rear surface, said bond paper sheet having a drawing portion and an integrated adhesive sticker or label portion;

a liner adhered by an adhesive to at least a portion of said rear surface of said adhesive sticker or label portion of said bond paper sheet; and a die cut through said bond paper sheet to form said at least one integrated adhesive sticker or label, said at least one integrated adhesive sticker or label being positioned over said liner adhered by an adhesive to at least a portion of said rear surface of said integrated adhesive sticker or label portion of said bond paper sheet;

wherein said drawing portion has indicia printed thereon to represent a scene and said sticker or label portion has at least one preprinted label associated with the scene represented in said drawing portion and wherein said drawing portion and said sticker or label portion are preprinted to provide entertainment and educational activities for children and other interested patrons.

2. The placemat having at least one integrated adhesive sticker or label in accordance with claim 1, wherein said liner is fabricated from silicone coated kraft paper and said adhesive is a pressure sensitive adhesive.

3. The placemat having at least one integrated adhesive sticker or label in accordance with claim 1, wherein said bond paper sheet is 20 to 28 pound bond.

4. The placemat having at least one integrated adhesive sticker or label in accordance with claim 2, wherein said bond paper sheet is 20 to 28 pound bond.

5. The placemat having at least one integrated adhesive sticker or label in accordance with claim 1, wherein said liner is fabricated from a 35# silicone-coated kraft liner and said adhesive is a pressure sensitive adhesive.

6. The placemat having at least one integrated adhesive sticker or label in accordance with claim 1, wherein a perforated line separates said drawing portion and said integrated adhesive sticker or label portion of said bond paper sheet.

7. The placemat having at least one integrated adhesive sticker or label in accordance with claim 6, wherein said perforated line is a micro-fine perforation which permits easy separation of said drawing portion and said integrated adhesive sticker or label portion of said bond paper sheet.

8. The placemat having at least one integrated adhesive sticker or label in accordance with claim 4, wherein a perforated line separates said drawing portion and said integrated adhesive sticker or label portion of said bond paper sheet.

9. The placemat having at least one integrated adhesive sticker or label in accordance with claim 8, wherein said perforated line is a micro-fine perforation which permits easy separation of said drawing portion and said integrated adhesive sticker or label portion of said bond paper sheet.

10. The placemat having at least one integrated adhesive sticker or label in accordance with claim 1, wherein said drawing portion and said integrated adhesive sticker or label portion are formed from a single sheet of 20 pound bond paper.

11. The placemat having at least one integrated adhesive sticker or label in accordance with claim 9, wherein said drawing portion and said integrated adhesive sticker or label portion are formed from a single sheet of 20 pound bond paper.

12. The placemat having at least one integrated adhesive sticker or label in accordance with claim 10, wherein said single sheet of 20 pound bond paper is rectangular in configuration and has an outside dimension of approximately 10½ inches by approximately 14 inches.

13. The placemat having at least one integrated adhesive sticker or label in accordance with claim 11, wherein said single sheet of 20 pound bond paper is rectangular in configuration and has an outside dimension of approximately 10½ inches by approximately 14 inches.

14. An article of manufacture comprising:

a placemat having a front surface, a rear surface, a drawing portion and an integrated adhesive sticker or label portion;

a liner adhered by an adhesive to at least a portion of said rear surface of said adhesive sticker or label portion of said placemat; and a die cut through said placemat to form said at least one integrated adhesive sticker or label being positioned over said liner, wherein said drawing portion has indicia printed thereon to represent a scene and said sticker or label portion has at least one preprinted label associated with the scene represented in said drawing portion.

15. The article of manufacture of claim 14 wherein said placemat is 20 to 28 pound bond paper, said liner is fabricated from silicone coated kraft paper and said adhesive is a pressure sensitive adhesive.

16. An article of manufacture comprising:

a placemat having a front surface and a rear surface, said placemat having a drawing portion and an integrated adhesive sticker or label portion, wherein said front surface of said drawing portion is preprinted to represent a scene and wherein said integrated sticker or label portion is preprinted to represent designs associated with the scene of said drawing portion;

a liner adhered by an adhesive to at least a portion of said rear surface of said adhesive sticker or label portion of said placemat; and at least one die cut formed in said placemat front surface to define with said adhesive at least one integrated adhesive sticker or label.

* * * * *